US008734218B2

(12) United States Patent
Caraballo

(10) Patent No.: US 8,734,218 B2
(45) Date of Patent: May 27, 2014

(54) POKER GAME WITH WAGER RETURN FEATURE

(76) Inventor: Pablo Caraballo, Las Vegas, NV (US)

( * ) Notice: Subject to any disclaimer, the term of this patent is extended or adjusted under 35 U.S.C. 154(b) by 336 days.

(21) Appl. No.: 13/071,313

(22) Filed: Mar. 24, 2011

(65) Prior Publication Data

US 2011/0250942 A1 Oct. 13, 2011

Related U.S. Application Data

(60) Provisional application No. 61/323,273, filed on Apr. 12, 2010.

(51) Int. Cl.
*A63F 9/24* (2006.01)
*A63F 1/00* (2006.01)

(52) U.S. Cl.
USPC ..... 463/13; 463/25

(58) Field of Classification Search
USPC ..... 273/292; 463/13, 25
See application file for complete search history.

(56) References Cited

U.S. PATENT DOCUMENTS

| | | | | |
|---|---|---|---|---|
| 6,102,402 | A * | 8/2000 | Scott et al. | 273/292 |
| 6,637,747 | B1 * | 10/2003 | Garrod | 273/292 |
| 7,092,011 | B2 * | 8/2006 | Silverbrook et al. | 348/207.2 |
| 7,611,404 | B1 * | 11/2009 | Hilf et al. | 463/13 |
| 2003/0042679 | A1 * | 3/2003 | Snow | 273/292 |
| 2005/0107148 | A1 * | 5/2005 | Webb | 463/13 |
| 2005/0179206 | A1 | 8/2005 | Cogert | |
| 2007/0075497 | A1 | 4/2007 | Friedman | |
| 2007/0155460 | A1 | 7/2007 | Burnside et al. | |
| 2007/0210519 | A1 * | 9/2007 | Barlev | 273/292 |
| 2008/0012222 | A1 * | 1/2008 | Starzec | 273/292 |
| 2008/0088087 | A1 | 4/2008 | Weitzman et al. | |
| 2008/0111308 | A1 * | 5/2008 | Snow | 273/292 |
| 2008/0237985 | A1 | 10/2008 | Cogert et al. | |
| 2009/0315264 | A1 * | 12/2009 | Snow et al. | 273/292 |

OTHER PUBLICATIONS

Thoughts on Killing Variance—Poker Theory—General Poker Theory, http://forumserver.twoplustwo.com/15/poker-theory/thoughts-kiling-variance_464753, Apr. 19, 2009, 9 pages, selway.
Idea for a new game—Poker Theory —General Poker Theory Forum, http://forumserver.twoplustwo.com/15/poker-theory/idea-new-game-539826, Jul. 22, 2009, 7 pages, Sorrybadbeat.
Poker without bad beats—Poker Theory—General Poker Theory Forum, http://forumserver.twoplustwo.com/15/poker-theroy/poker-without-bad-beats-868075, Sep. 4, 2010, 3 pages, pusherman.

* cited by examiner

*Primary Examiner* — David L Lewis
*Assistant Examiner* — Shauna-Kay Hall
(74) *Attorney, Agent, or Firm* — Lightbulb IP, LLC

(57) ABSTRACT

A return feature for poker games may be activated after at least two all-in wagers to a pot have been made. The player having the current best hand at the time of the all-in wagers may be returned a portion of the pot regardless of whether or not the player ultimately wins. This allows this player to continue playing should he or she lose the all-in wager. The return feature may return various portions of the pot to a player and may be used in both electronic and non-electronic embodiments of poker.

6 Claims, 4 Drawing Sheets

POKER GAME WITH WAGER RETURN FEATURE

CROSS-REFERENCE TO RELATED APPLICATION

This application claims priority to U.S. Provisional Patent Application No. 61/323,273, titled Poker Game with Wager Return Feature, filed Apr. 12, 2010.

BACKGROUND OF THE INVENTION

1. Field of the Invention

The invention relates to poker games generally, and specifically to a poker or poker-type game having a wager returning feature for bad beat events.

2. Related Art

A common "annoyance" in poker and poker-type games is what is known as a bad beat which generally occurs when generally ill-advised play results in a weaker hand becoming the winning hand seemingly as a stroke of sheer luck. Traditional attempts at addressing bad beats are quite intrusive in that they alter game play such as by requiring players to declare winning hands, requiring separate jackpots for bad beat losers. In addition, traditional attempts have been shown to be ineffective in curbing play, especially by inexperienced players, that leads to bad beats.

From the discussion that follows, it will become apparent that the present invention addresses the deficiencies associated with the prior art while providing numerous additional advantages and benefits not contemplated or possible with prior art constructions.

SUMMARY OF THE INVENTION

A return feature for various poker games is disclosed herein. The return feature reduces the effect of luck on particular aspects of the game of poker. In general, the return feature allows a player to continue playing where the player would have traditionally been required to retire because of losing all of his or her funds. The return feature may be triggered or activated by particular events during a poker game and may result in one or more players being returned a portion of the pot. In one or more embodiments, the return feature may be activated when a first all-in wager is made and then raised or called, and/or when two or more all-in wagers have been made. In this manner, the return feature may prevent one or more players from losing all their funds and thus such players may continue playing the game.

The return feature may have various configurations including both systems and methods. To illustrate, in one embodiment, the return feature may be used in method for conducting a poker game for one or more players. Such a method may include dealing one or more physical playing cards to one or more players, accepting a first all-in wager from a first player, and accepting a second wager from a second player into the pot. The second wager may be a matching wager, such as an all-in wager, call wager, and/or raise wager, that (if made) activates the return feature. The first and second wager are added to the pot;

After the second wager has been accepted, a first rank may be assigned for the physical playing cards of the first player according to a ranking table for the poker game. A second rank may then be assigned for the physical playing cards of the second player according to the ranking table as well. The hands may consist of a predefined number of physical playing cards and the ranking table may identify one or more rankings for combinations of cards having less than the predefined number of physical player cards.

The first rank and the second rank may then be compared. A portion of the pot may be returned to the first player if the first rank is higher than the second rank, and to the second player if the second rank is higher than the first rank.

One or more additional physical playing cards may then be dealt. These may be community cards used to complete the players' hands. In a game of hold'em for example, the additional physical playing cards may be the flop, turn, and/or river cards. The poker game may then end or conclude by comparing hands formed with the physical playing cards dealt to the one or more players and one or more of the one or more additional physical playing cards. A winning hand may be identified as a result of this comparison. A remaining portion of the pot may be paid to a player with the winning hand.

In another embodiment the return feature may be used in a method for conducting a poker game for one or more players. Such a method may comprise dealing one or more unexposed player cards to one or more players (the one or more unexposed player cards being physical playing cards), and conducting one or more betting rounds. A betting round may comprise receiving a wager or a decision to fold from each of the one or more players, if received, adding the wager to a pot.

An all-in wager and a first player that placed the all-in wager, and a second player that placed a matching wager after the all-in wager during may be identified during the one or more betting rounds. A first partial hand comprising the first player's unexposed player cards may then be compared to a second partial hand comprising the second player's unexposed player cards. The first partial hand and the second partial hand may then be ranked. A portion of the pot may be returned to the first player if the first partial hand outranks the second partial hand, and to the second player if the second partial hand outranks the first partial hand.

It is noted that comparison of the first partial hand and the second partial hand and returning a portion of the pot may only occur for a preselected one or more of the one or more betting rounds (i.e., the return feature may not be available or be deactivated for all betting rounds). It is contemplated that a bonus award may be given to the first player and second player if the first partial hand and the second partial hand have the same rank.

The method may also include exposing one or more community cards (the one or more community cards also being physical playing cards). A first complete hand comprising the first player's unexposed player cards and one or more of the community cards may be compared to a second complete hand comprising the second player's unexposed player cards and one or more of the community cards. The poker game may end by ranking the first complete hand and the second complete hand. The first player may be identified as a winning player if the first complete hand outranks the second complete hand. Alternatively, the second player may be identified as the winning player if the second complete hand outranks the first complete hand.

It is noted that the first complete hand and the second complete hand may consist of five cards while the first partial hand and the second partial hand consist of fewer than five cards. A partial hand paytable configured to rank a plurality of partial hands may be provided as well. The first partial hand and the second partial hand but not the first complete hand and the second complete hand may then be ranked according to the partial hand paytable.

A third player that placed a matching wager after the all-in wager during the one or more betting rounds may also be identified. If identified, the first partial hand and the second partial hand may be compared to a third partial hand comprising the third player's unexposed player cards and ranking the first partial hand and the second partial hand and the third partial hand. The portion of the pot that is returned may be a first amount if only the second player placed a matching wager, or be a second lower amount if the second player and the third player placed a matching wager.

In another exemplary embodiment, a gaming machine may be used. For example, a gaming machine for presenting a poker game with a return feature may be provided. The gaming machine may comprise one or more input devices and a display, and be configured to present a game with the return feature. For example, the gaming machine may be configured to associate one or more player cards with one or more players, and present the one or more player cards on the display.

The gaming machine may also be configured to accept an all-in wager from a first player via one or more of the one or more input devices, and receive a matching wager from a second player. The all-in wager and the matching wager may be added to the game's pot. It is noted that the gaming machine may receive the matching wager from the second player by receiving an indicator that the matching wager has been placed by the second player.

The machine may compare a first partial hand comprising the first player's one or more player cards to a second partial hand comprising the second player's one or more player cards to determine a ranking for the first partial hand and the second partial hand.

A predetermined portion of the pot may then be allocated to the first player if the first partial hand outranks the second partial hand, and to the second player if the second partial hand outranks the first partial hand. For example, a quarter of the pot may be allocated to a player to permit the player to continue playing one or more rounds of the poker game.

The gaming machine may also present one or more exposed community cards on the display, and compare a first complete hand comprising the first player's one or more player cards and one or more of the one or more community cards to a second complete hand comprising the second player's one or more player cards and one or more of the one or more community cards to determine a ranking for the first complete hand and the second complete hand. The gaming machine may include a memory device storing a paytable, and is further configured to rank the first complete hand and second complete hand according to the paytable.

A remaining portion of the pot may then be allocated to the first player if the first complete hand outranks the second complete hand, and to the second player if the second complete hand outranks the first complete hand. The remaining portion of the pot may be the pot minus the predetermined portion (that was returned/allocated to the highest ranking partial hand).

It is noted that the gaming machine may also receive one or more additional matching wagers from one or more additional players and add the one or more additional matching wager to the pot. The predetermined portion of the pot may be reduced for each of the one or more additional players from which at least one of the one or more additional matching wagers was received. In addition, the gaming machine may accept one or more other wagers (such as non-matching wagers) via at least one of the one or more input devices and add the one or more other wagers to the pot.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

Figure 1:
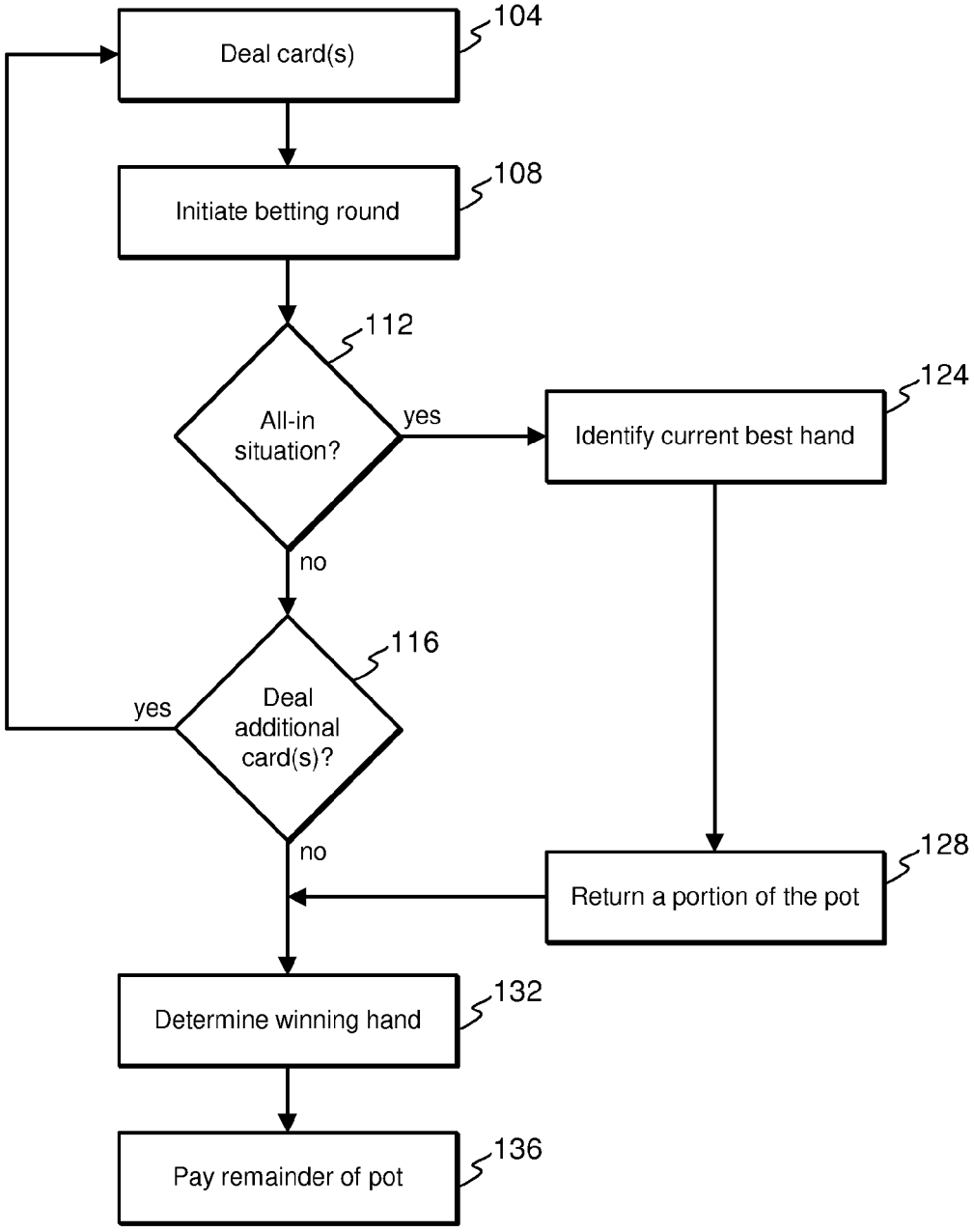
FIG. 1 is a flow diagram illustrating an exemplary return feature for poker games.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In various poker games, players are eliminated when they have wagered everything and lost. Typically, this occurs by an "all-in" wager in which a player bets all of his or her remaining funds or chips and loses. The all-in wager is a particularly powerful tool in the game of poker in that it requires a player to stake his or her ability to continue playing as well as his or her remaining funds (which may be substantial) on the outcome of the hand. In addition, any other player that wishes to continue playing for the pot must call or raise the original all-in wager. Traditionally, any player(s) that lose their remaining funds can no longer play.

Though players generally know the risks of making an all-in wager it is unfortunate for the player with the stronger or the strongest hand at the time the all-in wager was made to lose to a player having the weaker hand at the time of the wager. As stated, this is referred to as a "bad beat." To the losing player a bad beat is especially unfortunate where the player that had the weaker hand made his or her all-in wager because of inexperience and, as a stroke of luck, ended up winning the hand.

Moreover, in poker tournaments, experienced players can often play themselves into a statistically advantageous position if two or more players go all-in. For instance, in many cases, an experienced player can consistently make choices that give him or herself a 72% to 80% chance of winning the hand if two or more players go all-in. These statistics apply over time however. Thus, in a string of individual games, such as in a tournament setting, getting opposing players into a disadvantaged position often does not play out as expected. For these reasons, despite being the statistical favorite, a player may lose more times that the statistics would indicate or even every time in a string of individual games. In the case of an all-in wager, the player would traditionally be eliminated in spite of his or her ability to achieve a statistically advantageous position.

The return feature addresses this by reducing the amount lost for players who have made better decisions up to and/or including an all-in wager. In addition, the funds returned to the player allowed the player to continue to play one or more additional games eventually allowing his or her ability to gain the statistical advantage to work in the player's favor. In this manner, in a tournament setting, the return feature is highly advantageous in that it "weeds out" less skilled players more efficiently than traditional tournament structures. This increases the ability for a tournament to select a champion who is qualified for such a title.

As can be seen, bad beats are particularly irksome to experienced and professional players, especially in tournament settings. Given the random nature of poker games, inexperienced players can, in essence, exploit bad beats allowing them to beat other more experienced players. Though some bad beats are to be expected, bad beats are particularly demoralizing when they occur on an all-in wager. The losing player can no longer continue play. In addition, in a tournament, the losing player, no matter how experienced, would be eliminated because of a lucky draw by another player.

The poker game disclosed herein provides a wager return or refund feature which addresses the problem of bad beats. The return feature may be triggered by various events and at various stages of a poker game (or other card games). The return feature may apply or be activated/triggered in "all-in situations", such as where at least one player has made an all-in wager which is then raised or called and/or where two or more players have made all-in wagers. As used herein, the term matching wager refers to one or more subsequent raise, call, or all-in wagers that occurs after a first all-in wager and that activates/triggers the return feature. This is highly advantageous in that if a bad beat were to occur, the player that had the current best hand can not lose his or her entire wager. If that player made an all-in wager, the player can continue playing, where traditionally the player would be eliminated as a result of the bad beat.

As will be described further below, the return feature may be provided or used with a variety of equipment including electronic and non-electronic components. For example, the poker game may be played as a table game or via a gaming machine, console, or other electronic device.

The return feature will now be described with regard to the exemplary flow diagram of FIG. 1. It is contemplated that all or one or more of the steps contained in the flow diagram and described below may be applied to various poker games to implement the return feature. In this manner, the return feature may be used with poker games played according to different rules. In addition, though described in a particular sequence it is noted that various portions of the return features may occur in various orders, as will be described further below. In one or more embodiments, the return feature may be used in player versus player poker games. Alternatively or in addition, the return feature may be used in player versus dealer or electronic/simulated player poker games.

At a step 104 one or more cards may be dealt. The cards may be dealt to one or more players as individual cards and/or dealt as shared or community cards. A betting round may subsequently occur at a step 108. Wagers collected during the betting round may be combined into a pot. The amount and number of wagers may be controlled by the rules of the poker game currently being played.

At a decision step 112, it may be determined if an all-in situation has occurred. For example, it may be determined if at least one all-in wager and a call or raise was made during the betting round of step 108. Alternatively or in addition, it may be determined if at least two all-in wagers have been made. If an all-in situation has not occurred, it may be determined at a decision step 116 whether or not to deal one or more additional cards. This determination may be made according to the rules of the current poker game. For example, in Hold'em type poker games additional cards are typically not dealt after the river card is dealt. Prior to that however, additional cards may be dealt, namely the flop and turn cards.

At decision step 116, if no more cards are to be dealt a winner may be determined at a step 120, as will be described further below. If one or more additional cards may be dealt, such as according to the rules of the poker game being played, the cards may be dealt at step 104 such as described above. For instance, in a Hold'em type game, cards such as the flop, turn, or river cards may be dealt in one or more dealing "rounds." Each deal may be followed by a betting round such as shown by step 108 in FIG. 1.

If it is determined that an all-in situation has occurred during a betting round at decision step 112, the return feature may be said to be activated. As a result, at a step 124, the current best hand may be identified. Typically, such identification will occur only among the players who have made all-in wagers or have raised or called an all-in wager. The identification of a best hand may occur by comparing the ranking of the players' current hands and identifying the highest ranking hand. For example, the players' hands may be compared to a table, chart, or other listing of hand rankings for the poker game being played. In this manner, identification of the current best hand may occur according to the rules of the poker game being played. It is noted that the return feature may include its own hand rankings or methodology for determining the best hand in one or more embodiments. In this manner, determination of the current best hand may be said to be independent of the determination of the winning hand under the current game's rules.

An exemplary table of hand rankings (from highest rank to lowest rank) is provided in the following:

TABLE 1

| Hand | Description |
|---|---|
| Straight Flush | Five cards of the same suit in sequence |
| Four of a Kind | Four cards of the same value |
| Full House | Three cards of a first value and two cards of a second value |
| Flush | Five cards of the same suit |
| Straight | Five cards in sequence |
| Three of a Kind | Three cards of the same value |
| Two Pair | Two pairs of cards with each pair having the same value |
| One Pair | Two cards of the same value |
| High Card | The highest value card |

It is contemplated that multiple hand rankings may be used. For example, a partial hand ranking table or listing having rankings for partial on incomplete hands may be used rank the players' hands in their current state (i.e., before a complete poker hand is formed). The partial hand ranking table or listing may be separate and distinct from the table or listing used to rank complete hands to determine a winner of the game. It is contemplated that the partial hand ranking table may only provide rankings for hands having less than the full number of cards of a full hand (e.g., less than five cards in the case of a poker-type game).

Ties may be permitted in some embodiments. In the case of a tie, the amount returned may be split among the players who tie. Alternatively, a tie breaker may be used in other embodiments to prevent ties from occurring. For example, in the case of a tie, one or more high cards may be compared to determine the higher ranking hand. It is noted that tie breakers may be defined by the current poker game's rules in some embodiments or may be independently defined. For example, ties may be resolved by declaring the hand with the high card the current best hand. One or more high cards may be used to break ties among high cards. Alternatively, a tie breaker may not be used and each player may be returned a portion of the pot. For example, 25% of the pot may be returned to each player in the event of a tie.

It is contemplated that a bonus or jackpot feature may be included in some embodiments. For example, if it is revealed that the two (or more) players that placed an all-in wager and subsequent matching wager have a partial (or full) hand of the same ranking, these players may be given a bonus award. In one embodiment for example, the players may be automatically qualified for a poker tournament (and thus may play in the tournament). In another embodiment, the players may be paid a jackpot (e.g. split a jackpot) or given other award(s). The players given a bonus award may keep the bonus even if they ultimately do not win, in one or more embodiments.

As can be seen from FIG. 1, the current best hand may be determined at any point after at least one card has been dealt even though a complete five card hand is not yet possible. For example, one-card hands may be ranked and compared for a high card and the hand with the highest value being deemed the current best hand. Likewise, two-card hands may be ranked and compared for high cards and pairs. Accordingly, hands with more cards may be ranked and compared as well.

At a step 128, funds may be returned to the player having the current best hand as identified in step 124. Typically, the funds will be taken from the pot and returned to the player. This may occur in various ways. For example, the funds may be taken from the pot and paid to the player in one embodiment. In another embodiment, the funds may be first allocated to the player and subsequently paid (such as after the winning player is determined).

The amount returned to the player with the current best hand may vary. Typically, the amount will be less than the entire pot, such as a percentage of the entire pot. In one embodiment, the total amount of a particular player's wagers (in that game) may be returned. In another embodiment, a portion or percentage of the player's total wagers may be returned. For example, only the all-in portion of the player's total wagers may be returned. Alternatively, all of the player's wagers except for the all-in portion may be returned in some embodiments.

The amount returned by the return feature may depend on aspects or events of the game being played. For example, the amount returned may vary based on the number of players who have gone all-in (i.e., made all-in wagers or called or raised an all-in wager). To illustrate, if three players make all-in wagers, a different amount may be returned than if fewer or more players have gone all-in. In one embodiment for example, ⅛ of the pot may be returned if three players have gone all-in. In some embodiments, as the number of players that make all-in wagers increases, the return amount decreases.

When three or more players are involved in an all-in situation, the total pot increases by X per player; where X is the all-in wager amount. In Texas Hold'em for example, if three players go all-in preflop for $1000 each, the total pot becomes $3000. If a 25% return feature is activated, the player with the best hand at the time of the all-in receives $750 back. This means the player would only lose 25% of his original $1000 if the player loses the hand. This may be too much of an advantage for the player with the current best hand (or the player that thinks he or she has the current best hand). In some cases for example, a player with a strong hand may be incentivized to play aggressively or even to chase a bad beat.

Thus, with three or more players, the return percentage may be decreased in one or more embodiments. In one preferred embodiment, the best hand out of three all-in players would receive 12.5% or ⅛th of the pot. In this case, a player would be returned $375 of his or her original $1000 Like ¼th of a pot, ⅛th of a pot is advantageous in that is can also be easily calculated. For example, splitting one of four equal stacks in the pot in half produces the ⅛th split needed to accomplish this.

In another embodiment, when more than three players are involved in an all-in situation, the return feature may be disabled. A player's expectation of winning may decrease significantly as the number of players in the hand increases. At the same time, the pot generally increases significantly as the number of players in the hand increases. For example, if eight players are all-in preflop for $1000 each, the total pot becomes $8000. Returning the best hand even 12.5% of the pot at this point returns the best hand player his or her entire wager (i.e., the best hand player can not lose a chip). This could be considered unfair if the player can not lose a single chip and still have a shot at the $7000 left in the pot. For these reasons, in some embodiments the feature may be disabled in particular situations. More particularly, it is contemplated that the return feature may be disabled when more than three players are in an all-in situation where it is possible for a player to be returned his or her entire all-in wager. As discussed herein, an electronic calculating or computing device may be provided to determine when this is the case based on the current return amount or percentage, the pot total, and the amounts wagered by the players.

In one embodiment, a quarter (¼ or 25%) of the pot may be returned to the player with the current best hand. This is advantageous in that the ultimately winning player is rewarded while the losing player is returned sufficient funds to keep playing. In addition, a quarter of the pot may be easily calculated by the players, gaming personnel, or with one or more electronic devices.

It is contemplated that an alternate amount of the pot may be returned in some cases. For example, where the defined return amount is difficult or impossible to return, an alternate amount may be returned. To illustrate, if the pot is 3 chips or less and the defined return amount is ¼ or 25% of the pot, it would at least be difficult to return the defined amount. Thus, an alternate amount may be returned. For example, the amount nearest the defined amount may be returned. Alternatively, the minimum amount possible may be returned. In this case for example, a single chip may be returned to the current best hand player.

It is noted that the return feature could be anywhere from 5-40%, and preferably 25%. For example, at 25% in a heads-up preflop all-in pot of $2000, the best hand is returned $500 which equals half of their original $1000 wager. Using 25% is also easily calculated in a casino environment by splitting the chips into 4 equal stacks; awarding the best hand at the time of all-in 1 stack and awarding the winner the 3 remaining stacks.

It is noted that it is possible for the return feature to return amounts equal to or greater than 40% of the pot. Such amounts may be undesirable however. For example, if two players are involved in an all-in situation and each has wagered $1000, the total pot becomes $2000. If the return amount for the current winning hand is a larger amount, such as 50% of the pot, that player would receive their complete original wager of $1000 back and the other $1000 remaining in the pot would be awarded to the best hand after all cards are dealt. Thus, returning such an amount or percentage can provide too much of an advantage to the player with the best hand at the time of an all-in. To illustrate, in Texas Hold'em, such a high percentage of return makes it impossible to lose a single chip in a heads-up all-in hand while holding two Aces (i.e., pocket aces) preflop. Since two Aces is and will always be the best hand preflop in Texas Hold'em, having the triggered return feature at 50% or more may make the hand/return feature too powerful and unfair.

At step 132, the winning player may be determined. As with other steps of the return feature, determination of a winning player may occur according to the rules of the poker game being played. For example, if players must reveal their private or hole cards to determine the winning player, then such may occur. If additional cards must be dealt to determine the winning player, then this may also or alternatively occur. To illustrate, in a Hold'em type poker game, players typically reveal their hole cards to determine the winning player (when there are at least two players remaining).

The winning player is typically the player with the highest ranking hand. As discussed above, the players' hands may be ranked according to the hand ranking listing, table, or chart of the poker game being played. Also as discussed above, it is contemplated that multiple ranking charts, tables, or listings may be used in some embodiments. For example, a first hand ranking table may be used to determine the current best hand (at step 124) and a second hand ranking table may be used to determine the winning hand.

Resolution of ties may occur according to the poker game's rules. For example, if ties are permitted, there may be multiple winning players. It is noted that, in some embodiments, the return feature may provide the best hand player with more winnings than the winning player if a tie occurs. This is because the best hand player may be returned a portion of the pot in addition to his or her share of the pot as a winning player. This rewards the player with the best hand more than a winning player who may have tied the best hand player as the result of a lucky deal. In this manner, at least some of the time, players are rewarded for good play rather than the luck of the draw. If ties are not permitted, one or more tie breakers, such as defined by the poker game's rules, may be used to determine a single winner. For example, in the event of a tie, the player with one or more high cards may be declared the winner.

After a winning player is determined, a payout may be made to the winning player at a step 136. Typically, the winning player will be paid the pot minus the amount returned to the best hand. If ties are permitted, the pot may be split (equally or as defined by the poker game's rules) among winning players. It is noted that in some embodiments the return of funds to the best hand player, as described above with regard to step 128, may occur after a winner is determined in step 132. For example, as stated the return of funds may be an allocation of a portion of the pot with payment of the allocated portion occurring subsequently such as after a winning player is determined.

Some examples are now provided to aid in understanding the return feature. Though described with regard to a Hold'em type poker game, it will be understood that the principles of the following may be applied to various types of poker games. It is noted that though described with reference to the hand rankings of Table 1, one or more different ranking tables, charts, or listings may be used.

EXAMPLE 1

Player 1 has an A♠ A♥ and Player 2 has 8♠ 10♣ and both make all-in wagers before the flop. A comparison of the players' hands shows that Player 1 has the better hand in that Player 1's hand ranks higher on the exemplary rankings of Table 1. Player 1 may then be returned a portion of the pot. For example, 25% or a quarter of the pot may be allocated or paid to Player 1. The remaining 75% of the pot may then be awarded to the player that ultimately wins.

EXAMPLE 2

Player 1 has J♣ J♠ and Player 2 has 6♥ 7♥. The flop is 5♥ 6♣ 8♥. If they both make all-in wagers on the flop, Player 1 has the higher ranking hand (with a pair of Jacks) and thus a portion of the pot will be returned to Player 1. It is noted that though 6♥ 7♥ may be statistically favored as a winning hand, the best hand before the flop is that of Player 1 because J♣ J♠ with 5♥ 6♣ 8♥ beats 6♥ 6♣ with an 8♥ 7♥ 5♥.

EXAMPLE 3

Player 1 has 5♣ 5♦ and Player 2 has 10♠ J♥. If they both make all-in wagers before the flop, a portion of the pot would be returned to Player 1 because Player 1 had the higher ranking hand with the pair of 5s. Alternatively, if the flop is 10♣ 2♥ 2♦ and both players then make all-in wagers, Player 2 with two pair, 10s and 2s, will be returned a portion of the pot. Alternatively, if the turn is 5♠, the board is showing 10♣ 2♥ 2♦ 5♠, and both players then make all-in wagers, a portion of the pot will be returned to Player 1 as Player 1 had the best hand with the Full House.

It is noted that in some embodiments, the return feature need not be used anytime at least two players make all-in wagers. For example, in one embodiment, the return feature may not be activated on the turn, but may be available prior to that. To illustrate with regard to Example 3, if the players make all-in wagers on the turn, the player with the best hand at the time may not be returned any portion of the pot.

EXAMPLE 4

Player 1 has A♦ 9♦ and Player 2 has A♥ 2♠. They both make all-in wagers before the flop and the board presents double-pairs with K♠ K♦ Q♥ Q♦ 4♣. Player 1, with A♦ 9♦, is returned a portion of the pot because he or she had the current best hand at the time of the all-in wagers. The final hands of Player 1 and 2 may be deemed a tie since they both have double-pairs. In this case, Player 1 and 2 may split or share the remaining pot. For example, if ¼ of the pot was returned to Player 1, then Player 1 and 2 as tied winners may split the remaining ¾ of the pot, equally or otherwise.

As discussed above, a tie may be dealt with in various ways. For example, the player with the highest suited high card may be deemed the winner. Alternatively, the player with the high card may be deemed the winner. In Example 4, both players have an Ace high card. In this case, one or more high cards may be used to determine a winner. For example, because both players have an Ace, the next high card may be used to determine the winner. In this case, Player 1 with a 9♦ has the high card and thus may be deemed the winner. Example 5, as set out in the following, illustrates another way of handling ties.

EXAMPLE 5

Player 1 has A♠ K♠ and Player 2 has A♣ K♦ and both make all-in wagers before the flop. In this case, there is a tie for the current best hand assuming the cards are not ranked by suit. If the cards were ranked by suit a current best hand between Player 1 and 2 could be determined based on such ranking. In the case of a tie, a portion of the pot may be returned to each player. For example ¼ of the pot may be returned to each player. Alternatively, the players could share the return amount. For example, ⅛ of the pot could be returned to each player which adds up to a ¼ total return. Once the remaining cards are dealt, the winning player would then be awarded the remaining portion of the pot. In the case of a tie, the pot could be split or a tie breaker may be used, as discussed above.

It is contemplated that the return feature may be used with various parts or sub-games of a poker game. For example, the return feature may be activated during a side pot of a poker game in addition to or instead of during the main game. In general, the player with the current best hand at the time the side pot was created, such as by two or more players making all-in wagers, may be returned a portion of the side pot.

EXAMPLE 6

Player 1 has J♠ Q♥ and makes an all-in wager. Player 2 has A♦ A♣ and calls. Player 3 has K♠ K♥ and calls. Both Player 2 and 3 have Player 1 covered. The flop presents 9♦ 10♥ K♣ and Player 2 and 3 go all-in, creating a side pot. Player 3 has K♣ K♠ K♥ 10♥ 9♦ which currently beats Player 2's hand of A♦ A♠ K♣ 10♥ 9♦ and thus a portion of the side pot is returned to Player 3. If the turn provides A♥ and the river provides 2♣ (creating a board consisting of 9♦ 10♥ K♣ A♥ 2♣), Player 2 has the winning hand of A♦ A♣ A♥ K♣ 10♥ and thus is awarded the remainder of the side pot. A portion of the main pot may be returned to Player 2 for having the best hand A♦ A♣ in the preflop 3-way all-in situation. The remainder of the main pot may be awarded to Player 1 who has the overall best hand with a straight consisting of 10♥ J♠ Q♥ K♣ A♥.

Figure 2A:
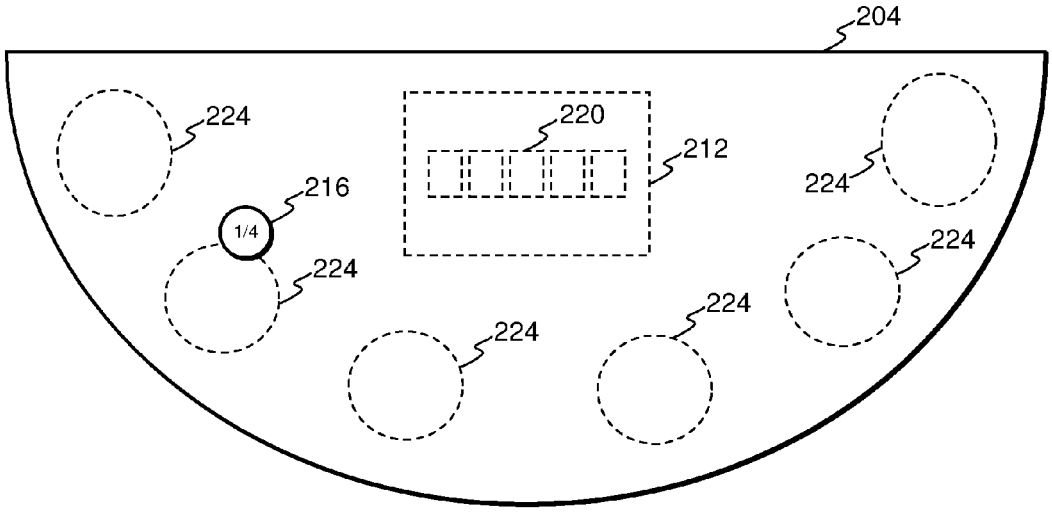
FIG. 2A is a top view of a gaming table used to implement an exemplary return feature.
Figure 2B:
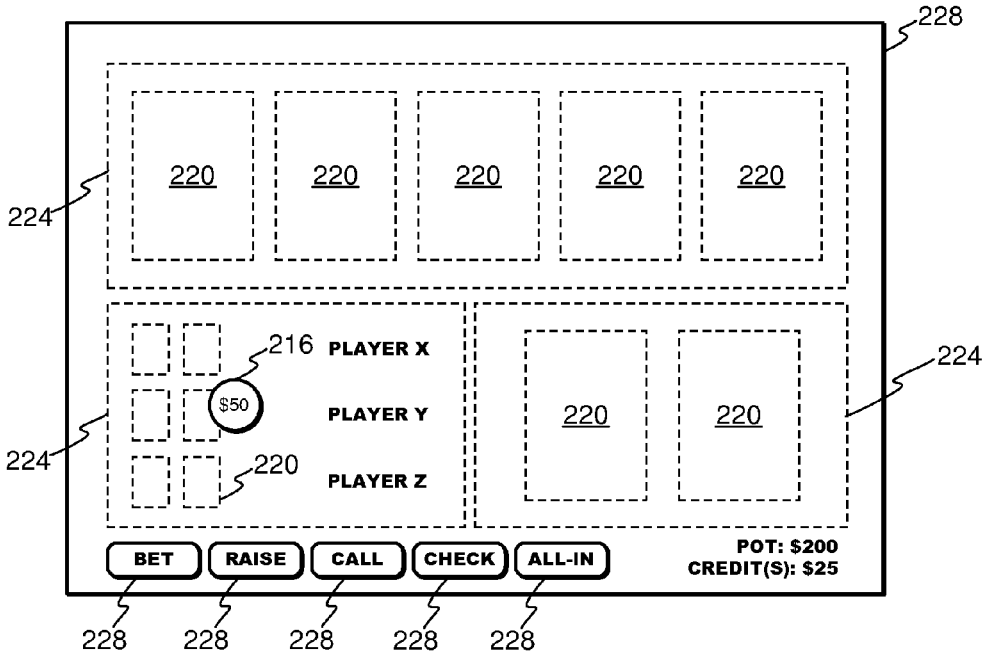
FIG. 2B is a front view of a gaming machine display used to implement an exemplary return feature.

The return feature may be used/implemented with various gaming equipment. This includes electronic and non-electronic equipment. In addition, a combination of electronic and non-electronic equipment may be used to provide the return feature. FIGS. 2A-2B provide examples of equipment for presenting, using, or implementing the return feature. It is noted that though some aspects are disclosed in relation to electronic equipment, these aspects may also apply to non-electronic equipment and vice versa.

FIG. 2A illustrates an exemplary gaming table 204 where the return feature may be implemented. As can be seen, the table 204 may have one or more player positions or areas 224. Cards 220 for individual players as well as wagers and other game play items may be associated with each player's area 224. For example, the button 216 labeled "¼" may be associated with a particular player area 224 to indicate certain game attributes for the player at that position, as will be described further below. One or more card areas 212 may be provided to present community cards 220 in one or more embodiments. Of course, such an area 212 may not be provided or used if the underlying poker game does not utilize such community cards 220.

FIG. 2B illustrates an exemplary display screen 228 upon which the return feature may be presented in an electronic format. Though not shown, it will be understood that the display screen 228 may be controlled by a gaming machine or similar device to implement the return feature. As can be seen, the screen 228 may also provide one or more player areas 224. The player areas 224 may be presented in various layouts and in various shapes and sizes. In FIG. 2B for example, the player area 224 having two cards 220 has been enlarged. This is beneficial because the enlarged or highlighted player area may be used to clearly present and/or draw attention to the cards belonging to the current player (i.e., the player at the screen 228). The player areas 224 may display one, some, or none of each player's cards heads up or heads down based on the rules of the underlying poker game. For example, as shown in FIG. 2B, cards 220 for Player X, Player Y, and Player Z as well as the current player may be displayed. The cards may be associated with the player that holds them. For example, FIG. 2B shows, player cards belonging to Players X, Y, and Z by presenting them adjacent these player identifiers. It is noted that, where a player is not permitted to see the cards of other players, only the current player's player area 224 may be displayed on the screen 228, or the other players' cards may be presented unexposed (e.g., face down) until an appropriate time during a game. One or more inputs 228, such as buttons may be provided to allow a player to interact/play the game.

Like the above, one or more card areas 212 may be provided to present community cards 220. One or more indicators, such as a button 216 may be provided at one or more player areas 224 to indicate a game attribute for one or more players associated with those areas as will now be described. As described above, the button 216 may have an informational display that may be configured to present information relating to the return feature. For example, in FIG. 2B, the button 216 displays "$50" (25% of the pot) which is the amount that will be returned to the current best hand player in the embodiment shown.

During play, cards 220 may be dealt to the player areas 224, card areas 212, or both. For example, in a game of Hold'em hole cards may be dealt to players associated with the player areas 224. These cards may be provided unexposed. Community cards such as the flop, turn, and river cards may be dealt to a card area 212. The community cards may be provided exposed for the players to see.

The button 216 may be used with the return feature in one or more embodiments. For example, the button 216 may be used to indicate which hand is the current best hand after at least two all-in wagers have been made. To illustrate, in a poker game where cards are face up (i.e., exposed to the players of the game), the button 216 may be associated with the player area 224 having the current best hand, such as by placing the button at the player area. This indicates which player will be returned a portion of the pot via the return feature as the game progresses. Referring back to FIG. 1, the button 216 may be placed at the appropriate player area 224 after the current best hand has been identified, such as in step 124 of FIG. 1. In addition, the presence of the button 216 at a player area 224 may indicate to players that the return feature has been activated.

As can be seen from FIGS. 2A-2B, the button 216 may be a physical object or an electronic indicator configured to identify or indicate the current best hand. The button 216 may carry or comprise an informational display to convey information regarding the return feature. In one embodiment, the button 216 may indicate the amount of return that the return feature provides. For example, in FIGS. 2A-2B, the button 216 has been labeled with "¼" to indicate a quarter of the pot (i.e., 25%) will be returned to the player holding the current best hand. Other characters, including numbers, may be used in one or more embodiments, to indicate a return amount or other information. For example, in poker games where the amount in the pot is known or tracked, it is contemplated that the informational display may present the amount that will be returned to the player with the current best hand. For example, assuming a pot of $100, the informational display may be updated to display $25 as the return amount.

In some embodiments, the button 216 may display information indicating the game being played has the return feature as described herein, or that the return feature has been activated in a game having the return feature. For example, the button 216 may be labeled with text, logos, or other information which alert players that the game includes a return feature. In one embodiment for example, the button 216 may be labeled "QB" to represent that the return feature will return a "quarter back" of the pot. The button 216 of these embodiments may be used as described above to indicate the current best hand, or may be used for other purposes. For example, the button 216 may be used as a dealer button to indicate the dealer of a game while also conveying the fact that the game being played is enhanced with the return feature. Likewise, the button 216 may be used to indicate which players must make big blind or small blind wagers, or provide other information regarding the game.

The informational display may be a substrate upon which information may be printed or otherwise applied. In addition, or alternatively the information display may be an electronic display, such as an LCD, LED, or other display. The information display may also include one or more light or sound emitters to draw attention to the button 216. This helps underscore the activation of the return feature which may deter some players from seeking a bad beat. For example, inexperienced players often chase after or aggressively bet when presented with flush or straight draws. The return feature counteracts this strategy especially where an all-in wager is contemplated or has been made.

The button 216 may have various shapes and colors such as to distinguish the button from other game play items, such as chips or markers. In one embodiment, the button 216 may be shaped like a push button for example. In another embodiment, the button 216 may be shaped like a puck. In yet another embodiment, the button may be square or rectangular. The button 216 may be yellow, blue, red, other colors, or a combination thereof. In one or more embodiments, the button 216 may have a color distinct from that of other game play items.

Figure 3:
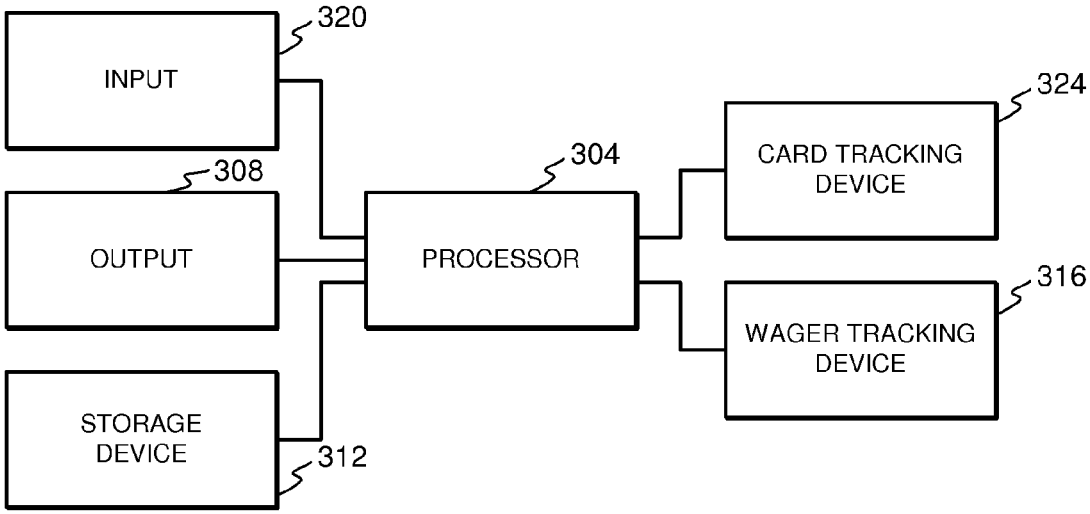
FIG. 3 is a block diagram showing an exemplary electronic system for implementing an exemplary return feature.

FIG. 3 illustrates an electronic system that may be used to implement the return feature. The components may be part of a gaming machine or console (or other electronic device configured to present a poker game), or may be part of a gaming table or the like. As shown, the components include a processor 304 having access to a storage device 312 and connected to an input device 320 and an output device 308. The components may also include a wager tracking device 316 and a card tracking device 324. It is contemplated that one or more of each component may be provided in various embodiments. For example, one or more input devices 320, such as touch screens and buttons, may be provided to receive various types of player or other input. As another example, multiple wager tracking device 316 and/or card tracking devices 324 may be used to track wagers and cards of individual players. In addition, some components may be omitted in some embodiments. The following disclosure may apply to embodiments for table games as well as gaming machines.

The storage device 312 may be used to store machine readable code which, when executed by the processor 304, implements the return feature. For example, machine readable code may implement some or all the steps described above with regard to FIG. 1. To illustrate, the machine readable code may be configured to detect all-in and/or matching wagers, identify the current best hand, calculate return amounts, or a combination thereof. The machine readable code may comprise one or more instructions which define the operation of the processor 304 and other components to provide the return feature. It is noted that the storage device 312 need not be in all embodiments because the machine readable code may be stored or hard wired within the processor 304 in some embodiments.

As stated briefly above, an input device 320 may be used to collect various types of input from various sources. Typically, an input device 320 will be used to collect player input. For example, in one or more embodiments, an input device 320 may be used to allow a player to electronically indicate that an all-in wager or a call or raise of an all-in wager (e.g., matching wager) has been made. To illustrate, the player may press a button or an area of a display screen to indicate that he or she has made an all-in wager or that he or she has called or raised an all-in wager.

Alternatively or in addition, all-in wagers may be automatically detected. For example, wagers may be electronically tracked, such as by RFID, optical, bill/coin acceptors or other wagering tracking devices 316. In this manner, the amount in the pot may be tracked or calculated. This permits the amount to be returned to a player to be determined automatically as well. In addition, all-in wagers may be detected in this manner. For example, a wager tracking device 316 may detect that a player has placed all of his or her chips (or other funds) as a wager and deem such a wager an all-in wager for the purpose of activating the return feature. A raise wager may be determined when a detected wager is larger than other wagers in that betting round. A call may likewise be determined by the amount of the wager compared to the previous wager amounts. In the case of a call, the detected wager may equal a previous wager to be deemed a call. Matching wagers may be detected as well in this manner. It is contemplated that players may explicitly place matching wagers, such as by pressing a "Call" button or "Raise button, such as shown in FIG. 2B.

It is contemplated that the one or more players may be playing at different gaming machines that are remote from one another. In such embodiments, a gaming machine may not physically receive or accept a wager since it may be remote from the player placing the wager. Thus, the gaming machine may receive an indicator or communication that indicates a remote player's wager has been received/accepted. For example, the remote player's wager may be accepted at a remote gaming machine and the remote gaming machine may communicate this information to notify other gaming machines of the wager.

One or more indicators, such as lights, sounds, or both, may be activated to alert players that there is a potential for the return feature to be activated such as by another player placing an all-in wager. The system may also or alternatively be configured to activate one or more indicators when the return feature is activated, such as at the time or after a second all-in wager has been made. In one embodiment, the system may include one or more output devices 316, such as lights, displays, speakers, or the like which provide such alerts. Alternatively or in addition, in some embodiments (such as table game embodiments), the system may communicate with the button to provide the alerts. For example, the system may include a wireless output device 316 which activates/deactivates lights, sounds, or changes information displayed on a button.

One or more card tracking devices 324 may be used to keep track of the hands of individual players. For example, the suit and value of dealt cards may be tracked by optical scanning, RFID tags, image recognition, or the like. As another example, in a gaming machine embodiment, the suit and value of dealt cards may be stored in a storage device 312 or memory of the gaming machine.

Card tracking allows the current best hand to be determined electronically. For example, the processor 304 may be configured to compare hands of two or more players as detected by a card tracking device 324 and to determine which hand is the current best hand, such as by comparing the hands to a hand ranking table or the like. The processor 304 may be configured to apply tie breakers or to declare a tie in different embodiments.

As can be seen, the electronic system may automate one or more aspects of the return feature. For example, the electronic system may detect all-in wagers and related raises or calls to determine if an all-in situation has occurred. The system may then compare the hands of the players that made all-in wagers and determine the current best hand. By tracking wagers, the system can calculate the total pot value and calculate the amount to be returned to the player having the current best hand. For example, the system may calculate the return amount based on a defined percentage or other portion of the pot. Where wagers are made electronically, the system may automatically transfer the return amount to the player's credits. It is noted that one or more aspects of the return feature may be implemented manually in some embodiments.

Figure 4:
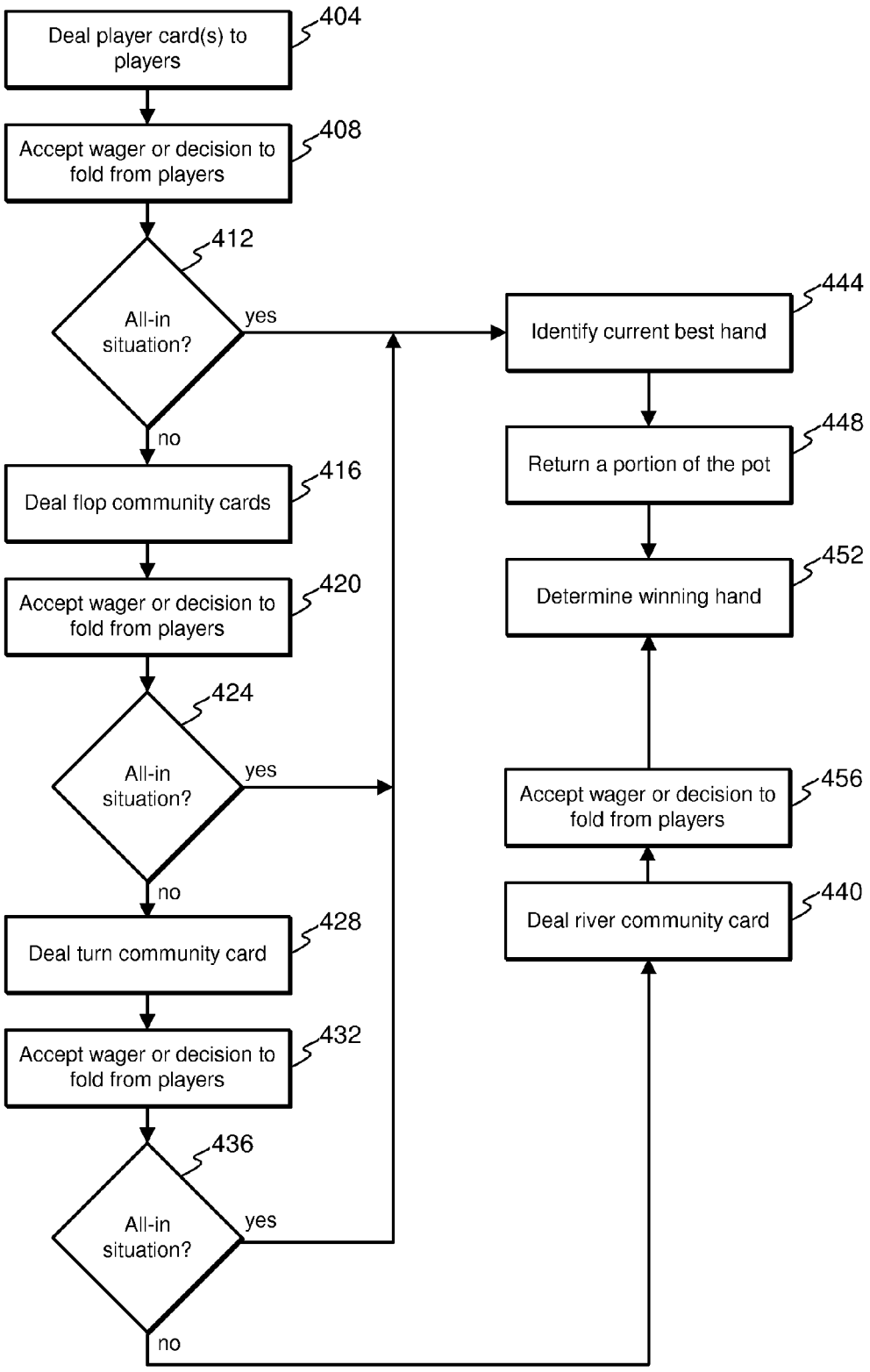
FIG. 4 is a flow diagram illustrating an exemplary return feature for a poker game.

FIG. 4 is a flow diagram illustrating operation of an exemplary poker game having the return feature. As can be seen, at a step 404 one or more player cards may be dealt to one or more players. In this exemplary game the player cards are private to each player and are dealt unexposed. Two player cards may be dealt to each player.

After viewing the player cards, each player may place a wager or fold at a step 408. It is noted that players may also have the option to check and not place an additional wager. Any placed wagers will be added to the poker game's pot. A player that folds forfeits his or her wager and is no longer permitted to continue playing the poker game. It is noted that in some embodiments, an initial wager, such as an ante may be required from one or more of the players even before the player cards are dealt. It is also noted that if all the players fold, the last player may receive any funds that are in the poker game's pot.

At a decision step 412, it may be determined if an all-in situation (e.g., a first all-in wager from one player followed by a matching wager from one or more other players) has occurred. If an all-in situation has occurred, then at a step 444, player hands comprising the player cards may be compared and ranked to determine the player with the current best hand. At a step 448, the player with the current best hand may be returned a portion of the pot. At a step 452, the poker game may be resolved, such as by dealing one or more community cards to allow the remaining players (the players that haven't folded) to form complete hands. For example, a flop, turn, and river card may be dealt. The player with the best complete hand may then be determined and awarded the remainder of the pot (i.e., the portion of the pot remaining after a portion was returned). It is contemplated that such player may be physically given the funds or such funds may be electronically allocated or assigned to the player, in the form of credits or the like.

If an all-in situation has not occurred at step 412, one or more flop community cards may be dealt at a step 416. For example, three flop cards may be dealt in a hold'em embodiment. The flop cards may be dealt exposed so that they function as community cards for the players to view and use in forming hands. At a step 420, the players may place an additional wager, check, or fold, such as described above with regard to step 408. At a decision step 424, it may be determined if an all-in situation has occurred from the wagers collected at step 420. If an all-in situation has occurred the game may continue at step 444 where the current best hand. Since the flop cards have been dealt, the current best hand may comprise the player's player cards and one or more of the flop cards. At the step 448, the player with the current best hand may be returned a portion of the pot. At the step 452, additional cards needed for the players to form complete hands may be dealt (e.g., the turn and river cards) to determine a winner of the poker game. The winner may then be given the remainder of the pot.

If an all-in situation has not occurred at step 424, a turn community card (or multiple turn community cards) may be dealt for the players to see and use at a step 428. The players may place an additional wager, check, or fold at a step 432. At a decision step 436 it may be determined if an all-in situation has occurred as a result of the turn community card being dealt. If an all-in situation has occurred, the game may continue at steps 444, 448, 452 as described above, except that the current best hand may include the turn card as well as the flop cards and player cards. If not, the river community card may be dealt at a step 440. An addition betting round may occur at step 456 where the players may place additional wagers or fold.

Subsequently, each remaining player may form a hand with the player cards and one or more community cards (i.e., the flop, turn, and river cards) and a winner may be determined by ranking the player's completed hands. The best or highest ranking complete hand may then be awarded the funds in the game's pot at step 452.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A gaming machine for presenting a poker game with a return feature, the gaming machine comprising one or more input devices and a display and configured to:

associate one or more player cards with one or more players;

present the one or more player cards on the display;

accept an all-in wager from a first player via one or more of the one or more input devices and add the all-in wager to a single pot;

receive a matching wager from a second player and add the matching wager to the single pot;

after the all-in wager and the matching wager are received, compare a first partial hand comprising the first player's one or more player cards to a second partial hand comprising the second player's one or more player cards to determine a ranking for the first partial hand and the second partial hand;

after the poker game completely ends, allocate a predetermined portion of the single pot to the first player if the first partial hand outranks the second partial hand, or to the second player if the second partial hand outranks the first partial hand, wherein a remaining portion of the single pot remains in the single pot after the predetermined portion of the single pot is returned;

present one or more exposed community cards on the display to generate a completed hand for each of the one or more players;

completely ending the poker game by comparing the completed hand of each of the one or more players to determine the highest ranking completed hand and a winning player, wherein the winning player is one of the one or more players holding the highest ranking completed hand; and allocate the remaining portion of the single pot to the winning player holding the highest ranking completed hand, the remaining portion of the single pot being the single pot minus the predetermined portion;

wherein the winning player is a different player than the first or second player to which the predetermined portion of the single pot was allocated.

2. The gaming machine of claim 1, wherein the gaming machine is further configured to:

receive a one or more additional matching wagers from one or more additional players and add the one or more additional matching wager to the single pot; and reduce the predetermined portion of the single pot for each of the one or more additional players from which at least one additional matching wager was received.

3. The gaming machine of claim 1, wherein the gaming machine comprises a memory device storing a paytable, and is further configured to rank the first complete hand and second complete hand according to the paytable.

4. The gaming machine of claim 1, wherein the gaming machine is further configured to accept one or more other wagers via at least one of the one or more input devices and add the one or more other wagers to the single pot.

5. The gaming machine of claim 1, wherein the predetermined portion of the single pot is a quarter of the single pot to permit a player allocated the portion of the single pot to play at least one more round of the poker game.

6. The gaming machine of claim 1, wherein the gaming machine is configured to receive the matching wager from the second player by receiving an indicator that the matching wager has been placed by the second player.

* * * * *